US008893358B2

(12) United States Patent
Fujiwara et al.

(10) Patent No.: US 8,893,358 B2
(45) Date of Patent: Nov. 25, 2014

(54) NEEDLE PUNCHER

(71) Applicant: Clover Mfg. Co., Ltd., Osaka-shi, Osaka (JP)

(72) Inventors: Yasuhiro Fujiwara, Osaka (JP); Rie Shirai, Osaka (JP)

(73) Assignee: Clover Mfg. Co., Ltd., Osaka (JP)

( * ) Notice: Subject to any disclaimer, the term of this patent is extended or adjusted under 35 U.S.C. 154(b) by 0 days.

(21) Appl. No.: 13/954,313

(22) Filed: Jul. 30, 2013

(65) Prior Publication Data

US 2014/0033487 A1 Feb. 6, 2014

(30) Foreign Application Priority Data

Aug. 2, 2012 (JP) ..... 2012-171849

(51) Int. Cl.
*D04H 18/02* (2012.01)

(52) U.S. Cl.
CPC ..... *D04H 18/02* (2013.01)
USPC ..... 28/107

(58) Field of Classification Search
USPC ..... 28/107, 109, 115, 110, 108; 223/102, 223/104; 112/226, 104, 439, 80.45, 80.03, 112/80.06, 80.05; 81/177.1; 30/337, 342
See application file for complete search history.

(56) References Cited

U.S. PATENT DOCUMENTS

| | | | | | |
|---|---|---|---|---|---|
| 223,146 | A | * | 12/1879 | Kidder | 279/91 |
| 526,291 | A | * | 9/1894 | Buckland | 279/29 |
| 608,926 | A | * | 8/1898 | Summer | 223/104 |
| 618,716 | A | * | 1/1899 | Nelson | 223/104 |
| 695,885 | A | * | 3/1902 | Padon | 223/104 |
| 802,247 | A | * | 10/1905 | Traxel | 30/367 |
| 846,253 | A | * | 3/1907 | Shear | 223/104 |
| 909,817 | A | * | 1/1909 | Parker | 223/104 |
| 1,118,190 | A | * | 11/1914 | Eagleston | 223/104 |
| 2,097,380 | A | * | 10/1937 | Morgan | 112/80.05 |
| 2,581,894 | A | * | 1/1952 | Wilson | 112/80.05 |
| 2,610,598 | A | * | 9/1952 | Midas | 112/80.05 |
| 3,050,896 | A | * | 8/1962 | Parker | 43/4 |

(Continued)

FOREIGN PATENT DOCUMENTS

| | | | |
|---|---|---|---|
| DE | 240038 | A1 * | 10/1986 |
| JP | 2004-308046 | | 11/2004 |
| JP | 3151522 | U | 6/2009 |

OTHER PUBLICATIONS

English language machine translation of JP 2004308046, Kuwabara, J. Nov. 4, 2004, obtained from http://worldwide.espacenet.com, 15 pages.*

*Primary Examiner* — Amy Vanatta
(74) *Attorney, Agent, or Firm* — Hamre, Schumann, Mueller & Larson, P.C.

(57) ABSTRACT

A needle puncher includes a needle and a grip member. The needle has a tip and a head spaced apart from each other in a longitudinal direction of the needle. The needle also has a held portion disposed between the tip and the head The grip member is configured to hold the needle in a manner such that the tip of the needle is exposed from the grip member. The grip member includes a holding portion and a grip portion. The holding portion holds the held portion of the needle, and the grip portion is gripped by a user of the needle puncher. The holding portion and the grip portion include front ends, respectively. The front end of the holding portion is closer to the head of the needle than the front end of the grip portion is.

5 Claims, 4 Drawing Sheets

(56) References Cited

U.S. PATENT DOCUMENTS 3,240,176 A * 3/1966 Morrison ..... 112/475.18
4,479,445 A * 10/1984 Walker ..... 112/80.05
4,886,003 A * 12/1989 Walker ..... 112/80.03
2009/0101052 A1 * 4/2009 Tamura ..... 112/104

* cited by examiner

NEEDLE PUNCHER

BACKGROUND OF THE INVENTION

1. Field of the Invention

The present invention relates to a handicraft needle puncher for use in the field of e.g. wool handicrafts such as appliqué.

2. Description of the Related Art

Needle punching technique is used typically in the manufacture of nonwoven fabric. In this technique, a plurality of webs of fibers are placed one on top of another and then, a needle is stuck through these webs to tangle fibers of different webs with each other, whereby the webs are combined. Such a needle punching technique is used also in the field of handcrafts. For instance, as a needle punching tool for handicrafts, a needle puncher is proposed which includes a plurality of needles attached to a grip member (see e.g. Patent Document 1 listed below).

In the field of handicrafts, a piece of felt which has a desired shape as a motif is placed on an appropriate sheet of cloth, and then, a needle is stuck through the cloth and the felt a number of times, so that fibers of the felt tangle with the fibers of the cloth, whereby an appliqué of the felt piece is made. According to the needle puncher disclosed in Patent Document 1, a plurality of needles can be stuck at one time through a piece of felt, which allows the work of making an appliqué to be performed efficiently. Needle punchers are also used for wool felt crafting in which a needle is repetitively stuck through a fluffy material of wool to form the fluffy material into a desired three-dimensional shape.

To make an appliqué of a complicated design, the piece of felt to be sewed often has a complicated shape including a plurality of small linear parts. A needle puncher having a plurality of needles is not suitable for sticking a needle through such a small part. Patent Document 2 discloses a needle puncher having a single needle. This needle puncher is configured to stick the needle through a small part. In this needle puncher, however, the needle is held by a grip member at a head-side portion distant from the tip. Further, the portion to be gripped by the user is arranged generally in the middle of the grip member. Thus, to stick the needle precisely through a small part, the position of the tip of the needle, which is distant from the portion where the user grips, needs to be controlled precisely, which is difficult. This makes the handicrafts using a needle puncher less enjoyable. Moreover, in the case of a needle puncher having a single needle, the force applied during the work is concentratedly exerted on the single needle. This may lead to breakage or the like of the needle.

Patent Document 1: JP-A-2004-308046

Patent Document 2: JP-U-3151522

SUMMARY OF THE INVENTION

The present invention has been proposed under the circumstances described above. It is therefore an object of the present invention to provide a needle puncher with which users can easily make an appliqué of a complicated design.

According to an embodiment of the present invention, a needle puncher is provided, which includes: a needle having a tip and a head spaced apart from each other in a longitudinal direction, and further having a held portion disposed between the tip and the head; and a grip member holding the needle in a manner such that the tip of the needle is exposed from the grip member. The grip member includes a holding portion and a grip portion, where the holding portion holds the held portion of the needle, and the grip portion is configured to be gripped by a user of the needle puncher. The holding portion and the grip portion have front ends, respectively, and the front end of the holding portion is closer to the head of the needle than the front end of the grip portion is.

Preferably, the grip portion includes a tapered part increasing in diameter as proceeding toward the tip of the needle, and the front end of the holding portion is closer to the head of the needle than the tapered part is.

Preferably, the front end of the holding portion is closer to the head of the needle than the grip portion is.

Preferably, the holding portion is formed with a through-hole having an inner surface to beheld in contact with the held portion of the needle.

Preferably, the needle includes a small-diameter portion and a large-diameter portion, where the small-diameter portion is connected to the tip of the needle, and the large-diameter portion is closer to the head of the needle than the small-diameter portion is. The large-diameter portion is greater in diameter than the small-diameter portion. The held portion of the needle is included in the large-diameter portion.

Preferably, the grip member includes an outer cylinder providing the grip portion and housing the holding portion. The outer cylinder is formed with a front opening through which the needle can pass. The front opening is greater in diameter than the large-diameter portion of the needle.

Other features and advantages of the present invention will become more apparent from detailed description given below with reference to the accompanying drawings.

DETAILED DESCRIPTION OF THE PREFERRED EMBODIMENTS

Preferred embodiments of the present invention are described below with reference to the accompanying drawings.

FIGS. 1-6 show an example of needle puncher according to the present invention. The needle puncher A of this embodiment is made up of a needle 1, a grip member 2 and a cap 3.

Figure 6:
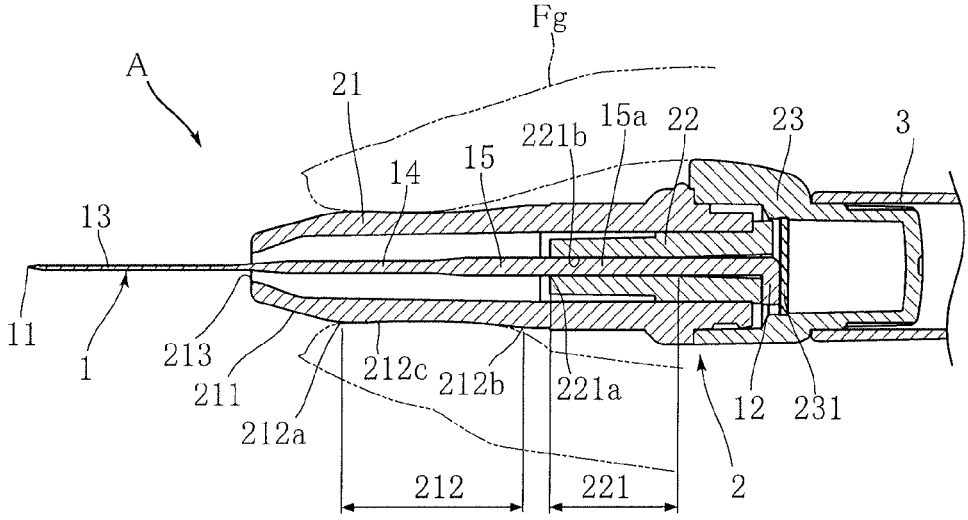
FIG. 6 is a schematic sectional view of the needle puncher in the state for use, taken along lines VI-VI in FIG. 3.

The needle 1 is made of a metal such as iron. As the needle 1, a needle designed for a needle puncher for use in the manufacture of nonwoven fabric can be employed. As shown in FIG. 6, the needle 1 includes a tip 11, a head 12, a small-diameter portion 13, a middle-diameter portion 14 and a large-diameter portion 15. The tip 11 has a sharp point so that the needle 1 can stick through a piece of felt in making e.g. an appliqué. The head 12 is provided at an end opposite from the tip 11. In this embodiment, the head 12 is made by bending a portion of the needle 1.

The small-diameter portion 13, the middle-diameter portion 14 and the large-diameter portion 15 are arranged in the mentioned order from the tip 11 side toward the head 12 side. The small-diameter portion 13 is directly connected to the tip 11. For instance, the small-diameter portion 13 has a plurality of small projections for catching fibers of felt. The middle-diameter portion 14 is directly connected to the small-diameter portion 13 and has a diameter slightly larger than that of the small-diameter portion 13. The large-diameter portion 15 is positioned on the head 12 side of the middle-diameter portion 14 and has a diameter larger than those of the small-diameter portion 13 and middle-diameter portion 14.

The needle 1 is held by the grip member 2. The grip member 2 is a member to be gripped by the user. In this embodiment, the grip member 2 is made up of an outer cylinder 21, an inner cylinder 22 and a press portion 23. The structure of the grip member 2 is not limited to this, and the grip member 2 may be made up of a larger number of parts or a smaller number of parts. The grip member 2 may be formed as a single-piece member.

The outer cylinder 21 is made of e.g. resin and has a cylindrical shape as a whole. The outer cylinder 21 includes a tapered portion 211, a grip portion 212 and an opening 213. As shown in FIG. 6, the outer cylinder 21 houses in it the inner cylinder 22. A part of the needle 1 projects from the opening 213. In this embodiment, the small-diameter portion 13 of the needle 1 projects from the opening 213 to be directly exposed to the outside. The diameter of the opening 213 is larger than that of the large-diameter portion 15 of the needle 1.

The tapered portion 211 is a portion of the outer cylinder 21 at which the opening 213 is formed. The outer diameter of the tapered portion 211 reduces as proceeding toward the tip 11 of the needle 1. The inner diameter of the tapered portion 211 gradually increases as proceeding from the opening 113 toward the deeper side (to the right in FIG. 6).

The grip portion 212 as a whole is closer to the head 12 of the needle 1 than the tapered portion 211 is. The portion indicated by the arrows with the reference sign 212 in FIG. 6 is the grip portion 212. The grip portion 212 is a portion to be gripped by a user with fingers and has a shape suitable for gripping. Specifically, in this embodiment, as shown in FIGS. 1-5, the grip portion 212 is slightly constricted at an intermediate portion in the longitudinal direction and has a hexagonal cross section. The boundary between the grip portion 212 and the tapered portion 211 is a front end 212*a* of the grip portion 212. The front end 212*a* corresponds to the tip-side end of the grip portion 212 in the present invention. As shown in FIG. 6, the point of the grip portion 212 at which the diameter is the maximum on the head 12 side of the needle 1 is the rear end 212*b* of the grip portion 212. A part of the grip portion 212 which is adjacent to the front end 212*a* is a tapered part 212*c*. The outer diameter of the tapered part 212*c* increases as proceeding toward the tip 11 of the needle 1.

The inner cylinder 22 is a portion for holding the needle 1. In this embodiment, the inner cylinder 22 is housed in the outer cylinder 21 at a position deviated to the right in FIG. 6. The inner cylinder 22 is made of e.g. a resin. The length of the inner cylinder 22 is shorter than that of the outer cylinder 21 and may be e.g. about one half of the outer cylinder 21. The inner cylinder 22 includes a holding portion 221. The holding portion 221 is a portion that holds the needle 1 and has a front end 221*a* and a through-hole 221*b*. The front end 221*a* corresponds to the tip-side end of the holding portion 221. The holding portion 221 holds a held portion 15*a* of the needle 1. The held portion 15*a* is an elongated portion extending in the longitudinal direction. In this embodiment, the held portion 15*a* is a part of the large-diameter portion 15. The inner cylinder 22 has a through-hole extending through the entire length, and a part of this through-hole which contributes to the holding of the needle 1 is the through-hole 221*b*. In this embodiment, therefore, of the through-hole extending through the entire length of the inner cylinder 22, the portion indicated by the arrows with the reference sign 221 in FIG. 6 is the through-hole 221*b*. The diameter of the through-hole 221*b* is substantially equal to or slightly larger than that of the large-diameter portion 15 of the needle 1. The inner surface of the through-hole 221*b* is in contact with the needle 1. In other words, of the through-hole extending through the entire length of the inner cylinder 22, the left portion in the figure has a diameter for coming into contact with the large-diameter portion 15 of the needle 1, and this portion is the through-hole 221*b*. Of the inner cylinder 22, the portion in which the through-hole 221*b* exists in the longitudinal direction is the holding portion 221. Of the through-hole extending through the entire length of the inner cylinder 22, the portion on the right side of the through-hole 221*b* in the figure has a diameter somewhat larger than that of the large-diameter portion 15 and is normally out of contact with the large-diameter portion 15. Of the large-diameter portion 15, the portion that is in contact with the through-hole 221*b* is the held portion 15*a*.

In this embodiment, the entirety of the holding portion 221, including the front end 221*a*, is arranged closer to the head 12 of the needle 1 than the grip portion 212 is. In other words, in the grip member 2, the grip portion 212, which is the portion to be gripped with fingers Fg, is positioned closer to the tip 11 of the needle 1 than the holding portion 221 holding the needle 1 is.

The press portion 23 is made of e.g. a resin and provided to prevent the needle 1 from detaching from the inner cylinder 22. In this embodiment, as shown in FIG. 6, the needle 1 is configured to be inserted into the inner cylinder 22 from the right side in the figure. The press portion 23 is removably attached to the outer cylinder 21 and the inner cylinder 22 by engaging the outer cylinder 21. The press portion 23 includes a press plate 231. For instance, the press plate 231 is a circular plate made of a metal. In the state in which the press portion 23 engages the outer cylinder 21, the press plate 231 presses the head 12 of the needle 1 against the inner cylinder 22.

Figure 1:
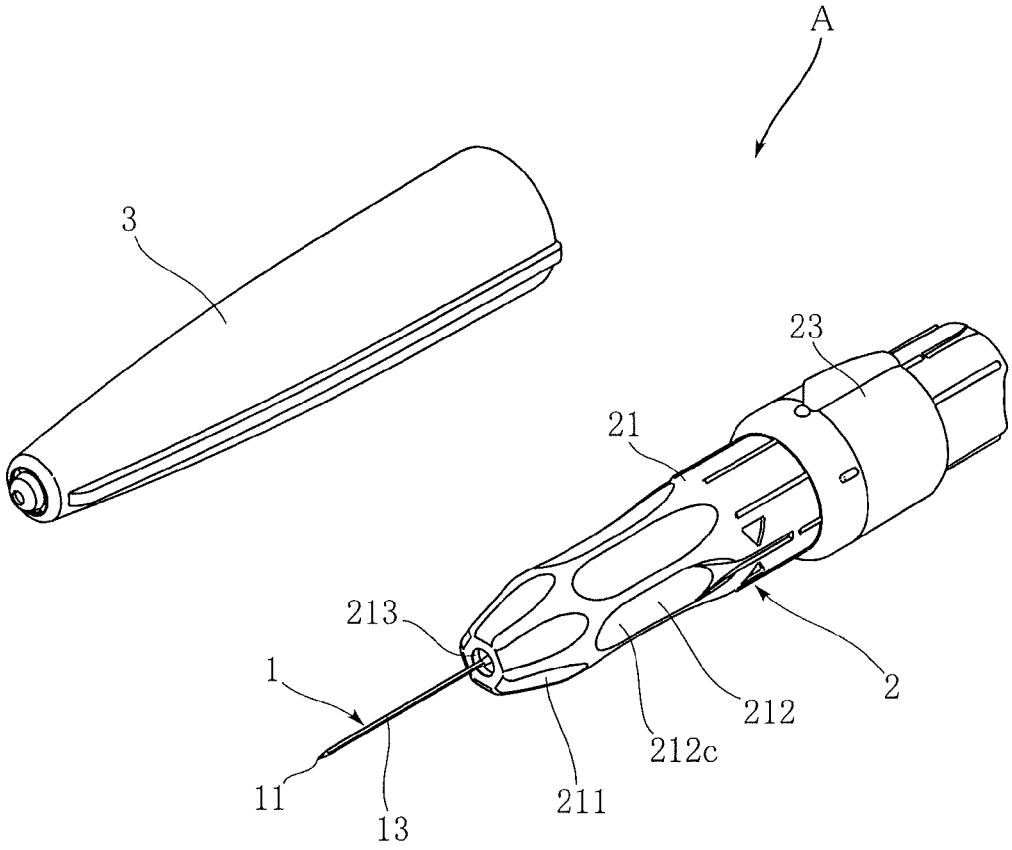
FIG. 1 is a perspective view showing a needle puncher according to a present invention.
Figure 2:
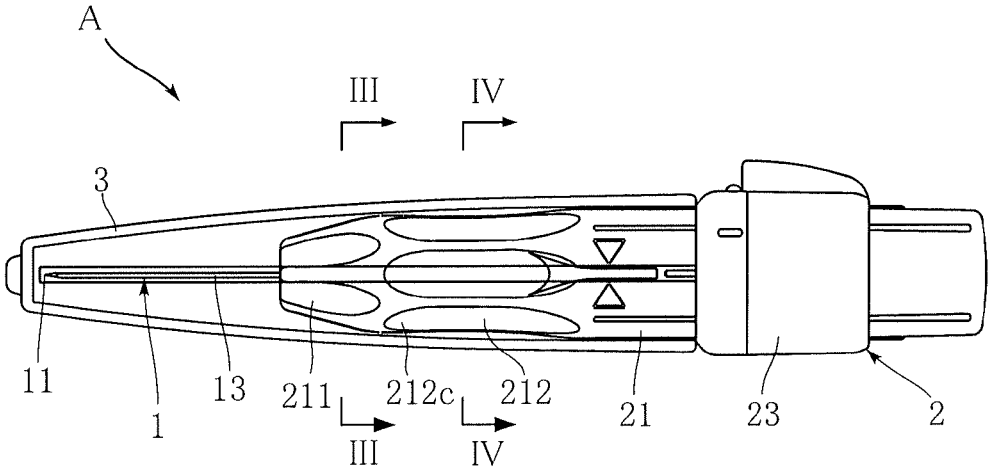
FIG. 2 is a side view of the needle puncher shown in FIG. 1.
Figure 3:
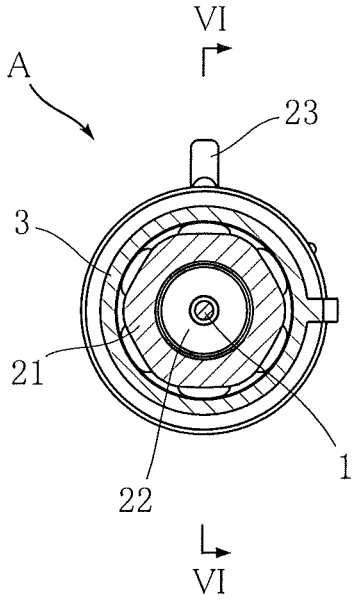
FIG. 3 is a sectional view taken along lines III-III in FIG. 2.
Figure 4:
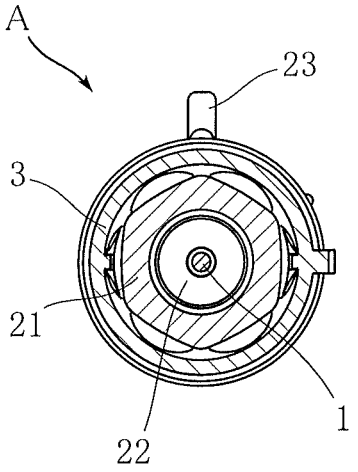
FIG. 4 is a sectional view taken along lines IV-IV in FIG. 2.
Figure 5:
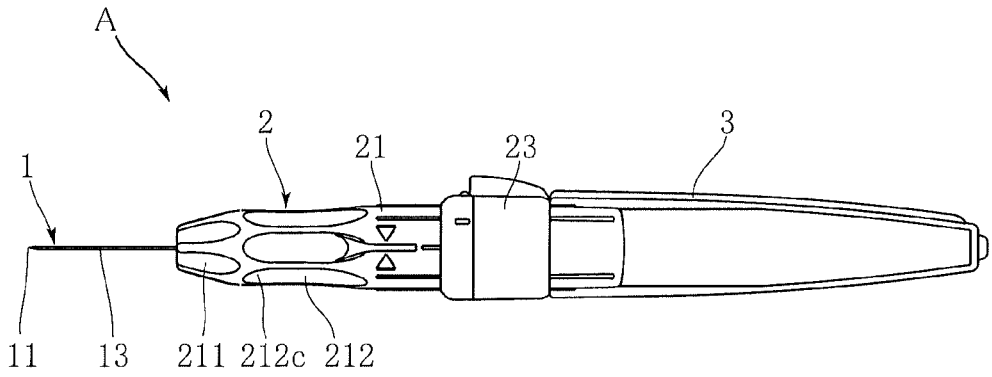
FIG. 5 is a side view of the needle puncher of FIG. 1 in the state for use.

The cap 3 is made of transparent resin, for example. The cap 3 is in the form of a cylinder with a bottom and tapers toward the front end. The shape and size of the cap 3 are configured to fit to both of the outer cylinder 21 and press portion 23 of the grip member 2. FIG. 2 shows the state in which the cap 3 is fitted to the outer cylinder 21. In this state, the needle 1 is covered by the cap 3. Thus, this state is suitable for storing the needle puncher A. FIGS. 5 and 6 show the state in which the cap 3 is fitted to the press portion 23. In this state, the needle 1 is exposed. The entire length of the needle puncher A in this state is longer than that in the state shown in FIG. 2, which allows the user to easily hold the needle puncher. Thus, this state is suitable for using the needle puncher A.

Advantages of the needle puncher A are described below.

When using the needle puncher A, the user holds the grip portion 212 with fingers Fg as shown in FIG. 6 and presses the needle puncher A as a whole against a target such as a piece of felt toward the tip 11 side (the left side in the figure). The arrangement of the needle puncher A makes it easier to finely control the position of the tip 11 than such an arrangement as disclosed in Patent Document 2 in which the portion to be gripped by the user is more distant from the tip 11 than the portion at which the needle 1 is held is. Thus, when the piece of felt has a complicated shape including e.g. a large number of small straight parts, the user can easily stick the needle 1 precisely through a desired part. Moreover, the portion (held portion 15*a*) of the needle 1 where it is held by the grip member 2 is on the head 12 side of the grip portion 212. While the needle puncher A is gripped with fingers Fg at the grip portion 212 that is relatively close to the tip 11, the distance from the tip 11 to the held portion 15*a* (distance from the tip 11 to the front end 221*a* of the holding portion 221) is relatively long. Thus, the force applied to the needle puncher A for the work is exerted on this relatively long part of the needle 1. If the force is exerted to only a short part of the needle 1 close to the tip 11, a large stress is exerted on the short part, which may result in breakage of the needle 1. In this embodiment, the force applied during the work is exerted on a relatively long part extending from the tip 1 of the needle 1 to the front end 221*a* of the holding portion 221, so that the stress exerted on the needle 1 is relatively small. This prevents problems such as breakage of the needle 1. Thus, with the needle puncher A, an appliqué of a complicated design can be made properly.

The front end 221*a* of the holding portion 221 is positioned close to the middle of the large-diameter portion 15 of the needle 1. When a force is applied during the work, a large stress tends to be exerted on the held portion 15*a* of the needle 1 or on the front end 221*a* in particular. Since these portions are positioned at the large-diameter potion 15, breakage of the needle 1 is reliably prevented.

As described above, to avoid breakage of the needle 1 while facilitating fine work, it is preferable that the grip portion 212 is closer to the tip 11 of the needle 1 than any point of the holding portion 212 is. However, the present invention is not limited to this arrangement. Most of the force with which the needle puncher A is pressed with fingers F is exerted on the tapered part 212*c* of the grip portion 212. Thus, arranging the front end 221*a* of the holding portion 221 closer to the head 12 than the tapered part 212*c* is prevents breakage of the needle 1 while facilitating fine work. Further, arranging the front end 221*a* of the holding portion 221 closer to the head 12 than the front end 212*a* of the grip portion 212 is prevents breakage of the needle 1 while facilitating fine work, as compared with e.g. the structure in which the grip portion 212 is more distant from the tip 11 than the holding portion 221 is.

The needle 1 is held with the large-diameter portion 15 held in contact with the inner surface of the through-hole 221*b* which has a considerable length. This prevents unfavorable tilt or movement of the needle 1 relative to the grip member 2.

The diameter of the opening 213 of the outer cylinder 21 is larger than the diameter of the large-diameter portion 15 of the needle 1. This arrangement prevents the needle 1 from coming into contact with the outer cylinder 21 even when the small-diameter portion 211 of the needle 1 is bent during the work.

The tapered portion 211 provided on the tip 11 side of the grip portion 212 allows the user to easily see the position of the tip 11 during the work.

The needle puncher according to the present invention is not limited to the foregoing embodiment. The specific structure of each part of the needle puncher according to the present invention may be changed in many ways in design.

The invention claimed is:

1. A needle puncher comprising:

a needle including a tip and a head spaced apart from each other in a longitudinal direction, the needle further including a held portion disposed between the tip and the head; and a grip member holding the needle in a manner such that the tip of the needle is exposed from the grip member;

wherein the grip member includes a holding portion and a grip portion, the holding portion holding the held portion of the needle, the grip portion being configured to be gripped by a user of the needle puncher, wherein the holding portion and the grip portion include front ends, respectively, and the front end of the holding portion is closer to the head of the needle than the front end of the grip portion is, wherein the grip portion includes a tapered part decreasing in internal surface diameter as proceeding toward the tip of the needle, and wherein the front end of the holding portion is closer to the head of the needle than the tapered part is, and wherein the needle is unfixed to the grip portion over a continuous range from the front end of the holding portion to the tip of the needle.

2. The needle puncher according to claim 1, wherein the front end of the holding portion is closer to the head of the needle than the grip portion is.

3. The needle puncher according to claim 1, wherein the holding portion is formed with a through-hole having an inner surface held in contact with the held portion of the needle.

4. The needle puncher according to claim 1, wherein the needle includes a small-diameter portion and a large-diameter portion, the small-diameter portion being connected to the tip of the needle, the large-diameter portion being closer to the head of the needle than the small-diameter portion is, the large-diameter portion being greater in diameter than the small-diameter portion, the held portion of the needle being included in the large-diameter portion.

5. The needle puncher according to claim 4, wherein the grip member comprises an outer cylinder providing the grip portion and housing the holding portion, and the outer cylinder is formed with a front opening allowing passage of the needle, the front opening being greater in diameter than the large-diameter portion of the needle.

* * * * *